US005729901A

United States Patent [19]

Fowler et al.

[11] Patent Number: 5,729,901

[45] Date of Patent: Mar. 24, 1998

[54] METHOD OF MANUFACTURING HOLLOW ARTICLES BY SUPERPLASTIC FORMING AND DIFFUSION BONDING

[75] Inventors: John O. Fowler, Shropshire; Arnold J. S. Pratt, Derbyshire, both of England

[73] Assignee: Rolls-Royce plc, London, England

[21] Appl. No.: 694,095

[22] Filed: Aug. 8, 1996

[51] Int. Cl.[6] ..... B23P 15/00

[52] U.S. Cl. ..... 29/889.72; 29/889.71; 228/157

[58] Field of Search ..... 29/889.72, 889.71, 29/889.721, 428, 458, 463, 897.31, 897.32; 228/157

[56] References Cited

U.S. PATENT DOCUMENTS

| | | | |
|---|---|---|---|
| 5,016,805 | 5/1991 | Cadwell . | |
| 5,141,146 | 8/1992 | Yasui | 228/157 |
| 5,253,419 | 10/1993 | Collot et al. . | |
| 5,285,573 | 2/1994 | LeMonds et al. . | |
| 5,344,063 | 9/1994 | Johnston et al. | 29/889.72 |
| 5,363,555 | 11/1994 | Fowler et al. | 228/157 |
| 5,457,884 | 10/1995 | Fowler et al. | 29/889.72 |
| 5,479,705 | 1/1996 | Fowler et al. | 228/157 |
| 5,581,882 | 12/1996 | Fowler et al. | 29/889.72 |

*Primary Examiner*—Irene Cuda

*Attorney, Agent, or Firm*—Cushman Darby & Cushman Intellectual Property Group of Pillsbury Madison & Sutro LLP

[57] ABSTRACT

A plurality of hollow blades are produced by assembling a plurality of titanium sheets and a plurality of titanium blocks into a stack. At least one of the sheets is provided with a stop off material on one of its surfaces at a plurality of longitudinally spaced pre-selected areas to prevent diffusion bonding at these areas to define the hollow interiors of the blades. The edges and ends of the sheets are welded together and the blocks are welded to the sheets. The assembly is heated and externally pressurised to diffusion bond the sheets and blocks together. The integral structure so formed is then heated and internally pressurised to superplastically form at least one of the sheets at each of the pre-selected areas to produce a plurality of hollow blades. Thereafter the hollow blades are separated from each other by machining and simultaneously producing the aerofoil shapes.

37 Claims, 8 Drawing Sheets

METHOD OF MANUFACTURING HOLLOW ARTICLES BY SUPERPLASTIC FORMING AND DIFFUSION BONDING

The present invention relates to the manufacture of hollow articles by superplastic forming and diffusion bonding processes, and is particularly concerned with manufacturing hollow compressor blades or fan blades for gas turbine engines.

It is known to manufacture hollow metallic fan blades for gas turbine engines by superplastic forming and diffusion bonding metallic workpieces, and one method is disclosed in our published European patent application No. 0568201 A1 and our published United Kingdom patent application No. 2269555A. These metal workpieces include elementary metals, metal alloys and metal matrix composites. At least one of the metal workpieces must be capable of superplastic extension.

Below a given size of blade, the cost of producing hollow blades in titanium is uneconomic. Currently the manufacture of hollow blades in titanium using superplastic forming and diffusion bonding is limited to fan blades.

The present invention seeks to provide a novel method of manufacturing hollow articles by superplastic forming and diffusion bonding which is more cost effective.

The present invention provides a method of manufacturing hollow articles by superplastic forming and diffusion bonding at least two metal workpieces comprising the steps of (a) defining a plurality of spaced preselected areas of at least one of the surfaces of at least one of the at least two metal workpieces to prevent diffusion bonding at the preselected areas, each preselected area corresponding to the hollow interior of one of a plurality of hollow articles, (b) assembling the at least two workpieces into a stack, (c) applying heat and pressure across the thickness of the at least two metal workpieces to diffusion bond the at least two workpieces together, in areas other than the plurality of spaced preselected areas to form an integral structure, (d) heating and internally pressurising the preselected areas to cause the preselected areas to be superplastically formed to produce a plurality of hollow articles of predetermined shapes, and a further step of parting the integral structure between the plurality of spaced preselected areas to provide a plurality of articles, said further step occurring between steps (c) and (d) or after step (d).

Preferably step (a) comprises applying a stop off material to prevent diffusion bonding at each of the plurality of spaced preselected areas.

Preferably each of the at least two metal workpieces has at least one flat surface, the stop off material is applied to at least one of the flat surfaces and the at least two workpieces are assembled into a stack relative to each other so that the flat surfaces are in mating abutment.

Preferably the method includes machining at least one of the at least two metal workpieces at a plurality of spaced preselected areas, the machined areas being on the surfaces opposite to the surfaces which are to be diffusion bonded together, each machined area corresponding to an exterior surface of one of the plurality of hollow articles, the machined areas having a varying mass distribution.

The heating and the internally pressurising of the preselected areas to cause the preselected areas to be superplastically formed to produce the hollow articles of predetermined shape may precede the parting of the integral structure between the plurality of spaced preselected areas to provide the plurality of hollow articles. One edge of the integral structure may be machined to form a plurality of root portions after heating and pressurising of the plurality of preselected areas to superplastically form the preselected areas to produce the hollow articles of predetermined shape and before parting of the integral structure between the plurality of spaced preselected areas to provide the plurality of hollow articles. After parting of the integral structure to provide the plurality of hollow articles, the remaining exterior surface portion of each of the articles may be machined to an aerofoil shape. The parting of the integral structure to provide the plurality of hollow articles may occur simultaneously with the machining of the remaining exterior surface portion of the integral structure to a plurality of aerofoil shapes.

The method may include partially parting the integral structure by forming slots from a first edge of the integral structure between the spaced preselected areas, heating the integral structure and applying loads to opposite ends of each of the plurality of articles to twist one end relative to the other end to contour each article to a predetermined shape after superplastically forming the spaced preselected areas to produce the hollow articles of predetermined shape and before parting of the integral structure. The edge opposite to the first edge of the integral structure may be machined to separate the articles and to form a plurality of root portions. After machining the roots, the twisted exterior surface portion of each of the articles may be machined to an aerofoil shape. The twisted exterior surface portion of each of the articles may be machined to an aerofoil shape. After machining the twisted exterior surface to an aerofoil shape, the edge opposite to the first edge of the integral structure may be machined to separate the articles and to form a plurality of root portions.

The method may include partially parting the articles by forming slots from a first edge of the integral structure between the spaced preselected areas, heating the integral structure and applying loads to opposite ends of each of the plurality of articles to twist one end relative to the other end to contour each article to a predetermined shape after diffusion bonding of the workpieces to form the integral structure and before superplastically forming the spaced preselected areas to produce the hollow articles of predetermined shape and parting of the integral structure. Before partially parting the articles, applying loads to the end opposite to the first end of the integral structure to camber said end. The edge opposite to the first edge of the integral structure may be machined to separate the articles and to form a plurality of root portions. After machining the roots, machining the twisted exterior surface portion of each of the articles to an aerofoil shape. The twisted exterior surface portion of each of the articles may be machined to an aerofoil shape. After machining the twisted exterior surface to an aerofoil shape, machining the edge opposite to the first edge of the integral structure to separate the articles and to form a plurality of root portions.

The parting of the integral structure between the plurality of spaced preselected areas to provide the plurality of articles may precede the heating and internally pressurising of the plurality of preselected areas to cause the preselected areas to be superplastically formed to produce the hollow articles of predetermined shape. Each of the plurality of articles may be heated and have loads applied to its opposite ends to twist one end relative to the other end to contour the article to a predetermined shape after parting of the integral structure into a plurality of articles and before heating and pressurising of the plurality of preselected areas to superplastically form the preselected areas to produce the hollow articles of predetermined shape. Before the opposite ends of each article are twisted, heat and loads are applied to one end of each article to camber said ends. The cambered end of each article may be machined to form a root portion. The remaining exterior surface portion of each article may be machined to an aerofoil shape.

The machining of the exterior surface of the article to an aerofoil shape may be electrochemical machining. The electrochemical machining may include trepanning the electrochemical machining electrodes.

Preferably the plurality of spaced preselected areas are spaced apart longitudinally of the workpieces. At least some of the plurality of spaced preselected areas are spaced apart transversely of the workpieces.

Preferably at least one metal block is assembled with the at least two metal workpieces into a stack so that the at least one metal block is at a first edge of the stack, and diffusion bonding the at least one metal block to the metal workpieces. Preferably two metal blocks are assembled at the first edge of the stack and on opposite surfaces of the stack.

At least one other metal block may be assembled with the at least two metal workpieces and the at least one metal block into a stack so that the at least one metal block is at a first edge of the stack and the at least one other metal block is at the opposite edge of the stack and diffusion bonding the metal blocks to the metal workpieces.

At least one metal block may assembled with the at least two metal workpieces into a stack so that the at least one metal block is at a central region of the stack and diffusion bonding the at least one metal block to the metal workpieces. Two metal blocks may be assembled at the central region of the stack and on opposite surfaces of the stack. The integral structure may be machined longitudinally through the centre of the at least one metal block.

The present invention will be more fully described by way of example with reference to the accompanying drawings, in which.

Figure 3:
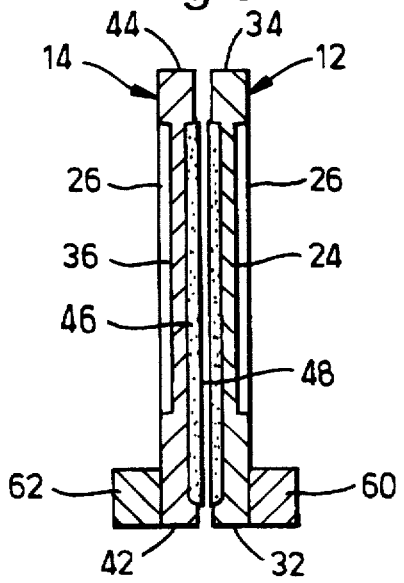
FIG. 3 is a cross-sectional view in the direction of arrows B—B in FIG. 2.

In FIG. 3, two sheets of titanium alloy 12, 14 are assembled into a stack 10. The sheets 12, 14 have mating surfaces 16, 18 which are flat.

Figure 1:
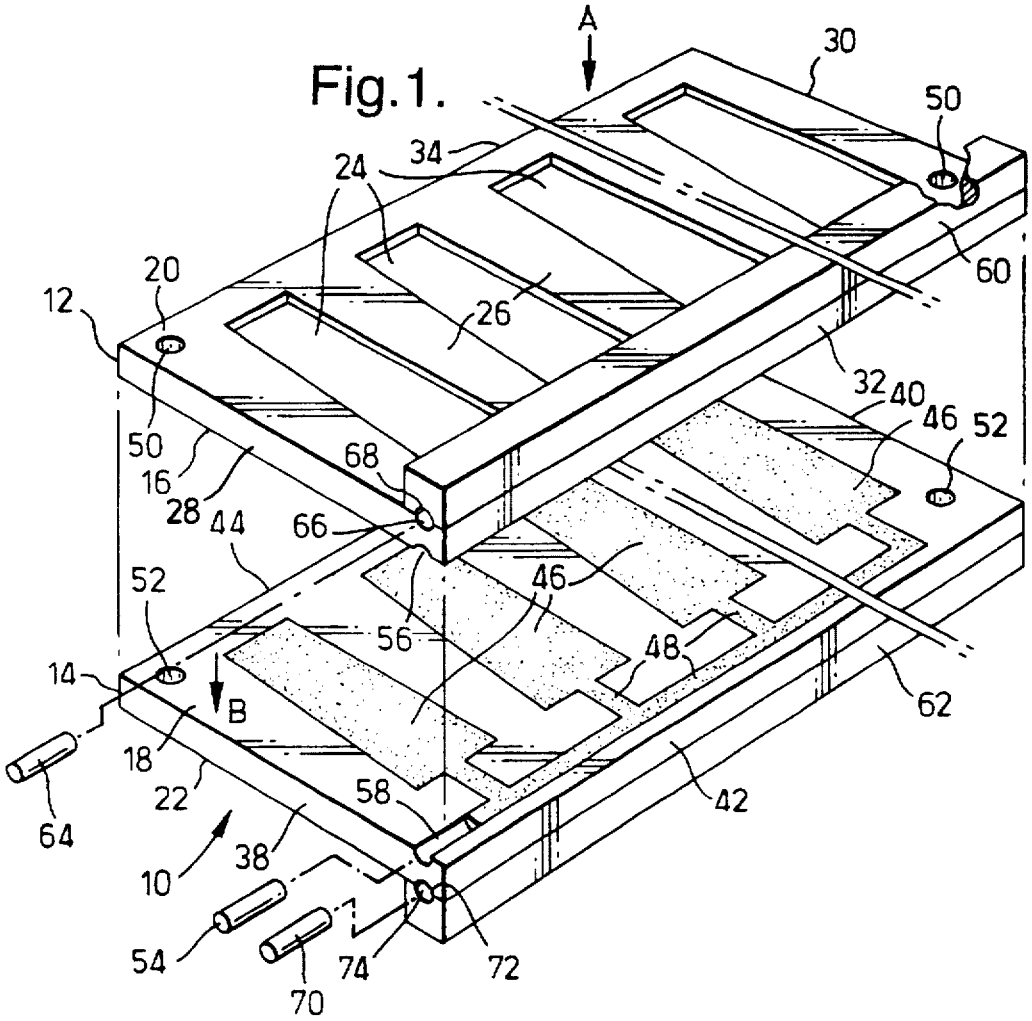
FIG. 1 illustrates a perspective view of a stack of workpieces which are superplastically formed and diffusion bonded to form a plurality of articles according to the present invention.
Figure 2:
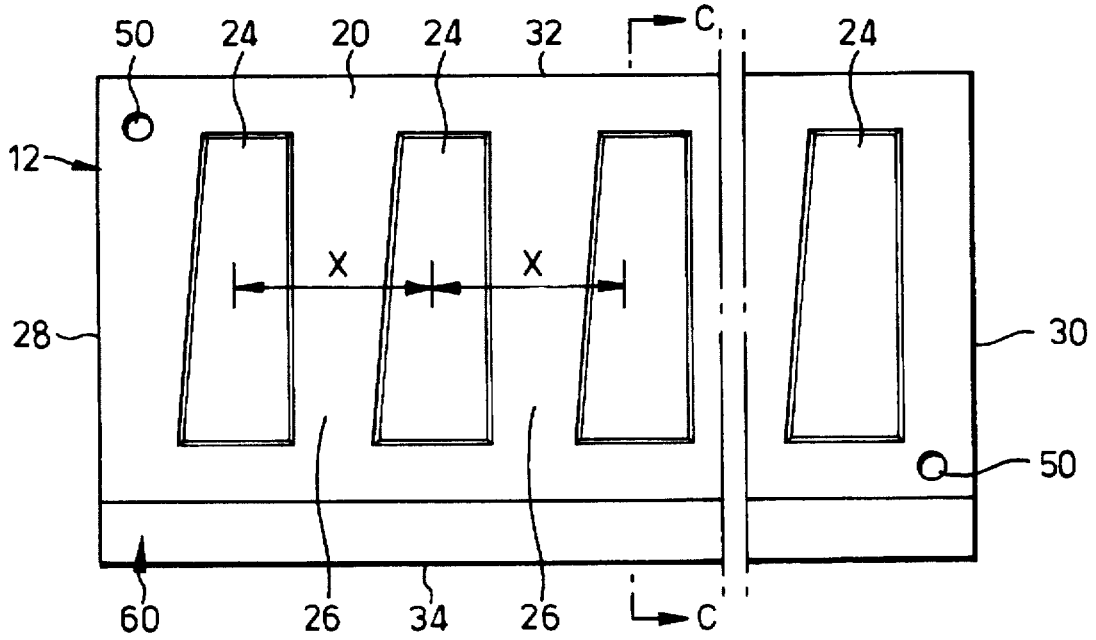
FIG. 2 is a view in the direction of arrow A in FIG. 1.

Prior to assembling the sheets 12, 14 into the stack 10, the surface 20 of the sheet 12 opposite to the flat mating surface 16, is machined at a plurality of preselected regions 24 which are spaced apart longitudinally of the sheet 12 by webs 26 as shown FIGS. 1 and 2. Each of the machined regions 24 corresponds to an outer surface of one of a plurality of hollow articles for example compressor blades. Each machined region 24 is contoured to produce a variation in the mass distribution of the compressor blade from leading edge to trailing edge and from root to tip by varying the depth of machining, i.e. by varying the thickness of the sheet 12 across the machined regions 24 in the direction between the ends 28 and 30 and in the direction between the edges 32 and 34 of the sheet 12.

Similarly the surface 22 of the sheet 14 opposite to the flat mating surface 18 is machined at a plurality of preselected regions 36 which are spaced apart longitudinally of the sheet 14 by webs (not shown). Each of the machined regions 36 corresponds to the other outer surface of one of the plurality of hollow articles. Each machined region 36 is also contoured to produce a variation in the mass distribution of the compressor blade from leading edge to trailing edge and from root to tip by varying the depth of machining, i.e. by varying the thickness of the sheet 14 across the machined regions 326 in the direction between the ends 38 and 40 and in the direction between the edges 42 and 44 of the sheet 14.

It is to be noted that the spacing between the machined regions 36 on sheet 14 is substantially the same as the spacing between the machined regions 24 on sheet 12 so that when the sheets 12 and 14 are arranged in the stack 10 each machined region 24 is substantially in alignment with a corresponding machined region 36 to define the outer surfaces of the hollow articles. Also there is a uniform separation X between corresponding features of the machined regions 24, 36 of adjacent articles.

The machining of the machined regions 24 and 36 of the sheets 12 and 14 is by milling, electrochemical machining, chemical machining, electrodischarge machining or any other suitable machining process.

The flat mating surfaces 16 and 18 of the sheets 12 and 14 are then prepared for diffusion bonding by chemical cleaning. One of the mating surfaces 16 and 18, in this example mating surface 18, has had a stop off material applied. The stop off may comprise powdered yttria in a binder and solvent, e.g. the stop off known as "Stopytt 62A" which is sold by an American company named GTE Service Corporation of 100 Endicott Street, Danvers, Mass. 10923, USA.

Figure 4:
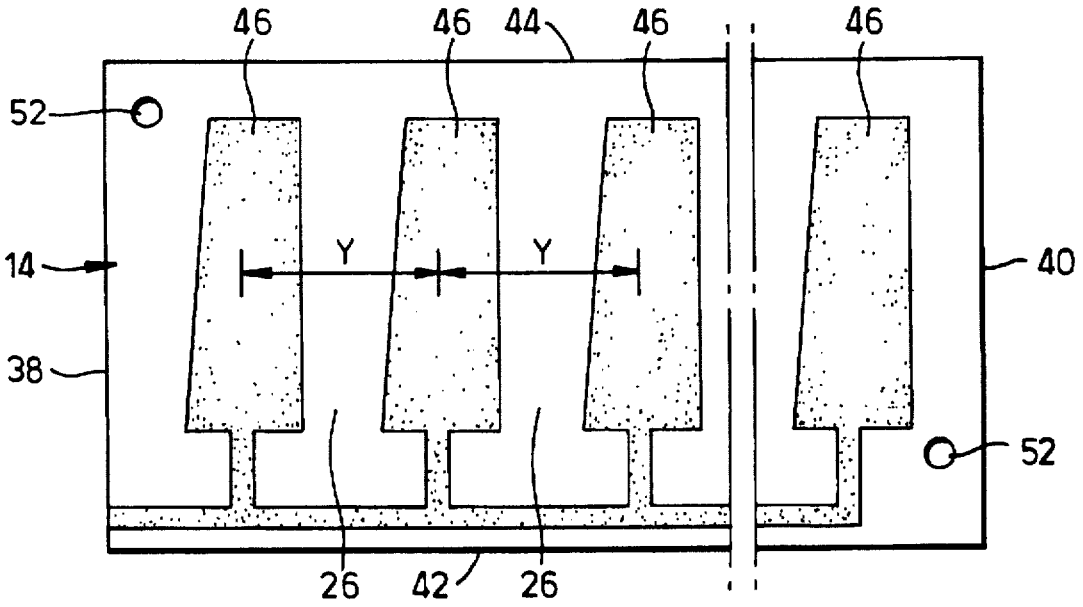
FIG. 4 is a view in the direction of arrow C in FIG. 1.
Figure 5:
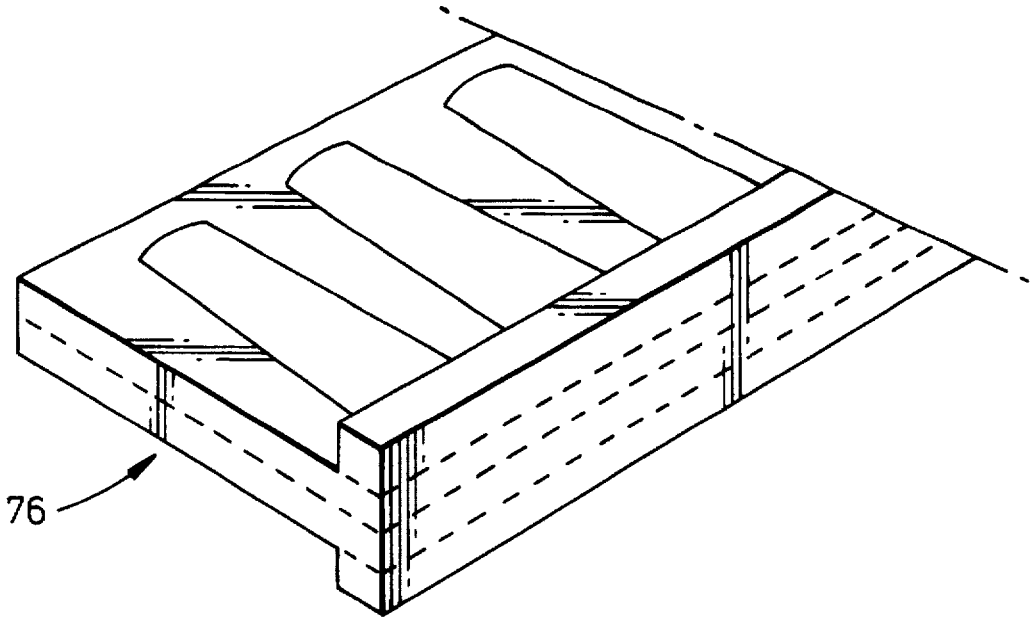
FIG. 5 illustrates a perspective view of the stack of workpieces after superplastic forming and diffusion bonding to form the articles.

The stop off material is applied in desired patterns at each of a plurality of preselected areas 46 which are spaced apart longitudinally of the sheet 14 as shown in FIGS. 1 and 4. The stop off material in this example is applied as a block to define a completely hollow article. There is a uniform separation Y between corresponding points of the stop off material 46 of adjacent articles. The separations Y and X are substantially the same. The stop off material is applied to the mating surface 18 such that when the sheets 12 and 14 are arranged in the stack 10 each preselected area 46 is substantially in alignment with the corresponding machined regions 24 and 36 on the sheets 12 and 14 to define the hollow interior of the hollow article. The stop off material is supplied by the known silk screen printing process or by any other suitable method. The preselected areas 46 are interconnected by a stop off material 48 which extends longitudinally near to one edge.

The two sheets of titanium alloy 12 and 14 are then assembled into the stack 10 as shown in FIG. 1. The sheet 12 has a pair of dowel holes 50 which are axially aligned with corresponding dowel holes 52 in sheet 14 to ensure the correct positional relationship between the two sheets 12 and 14 in the stack 10. The sheets 12 and 14 are maintained in this positional relationship by a pair of dowels (not shown) which are inserted into the axially aligned dowel holes 50 and 52.

The sheets 12 and 14 of the stack 10 are placed together to trap an end of a pipe 54. In this example a groove 56 is machined on surface 16 and a groove 58 is machined on surface 18. The end of the pipe 54 fits into the grooves 56 and 58 and projects from the stack 10. The end of the pipe 54 connects with the stop off material 46 and 48 between the sheets 12 and 14.

On completion of the assembly in the manner described it is welded about its periphery so as to weld the ends and edges of the sheets 12 and 14 together, and so as to weld the pipe 54 around its periphery to the sheets 12 and 14. A first sealed assembly is formed except for the inlet provided by the pipe 54.

At this stage two titanium blocks 60 and 62 are located on the stack 10. The titanium blocks 60 and 62 are to form the platform and root portions of the compressor blades. The titanium blocks 60 and 62 are positioned against the surfaces 20 and 22 of the sheets 12 and 14 respectively immediately adjacent the edges 32 and 42 respectively. The titanium blocks 60 and 62 extend the full length of the sheets 12 and 14 from the ends 28, 38 to the ends 30, 40. An end of a pipe 64 is trapped between the sheet 12 and the block 60, and the surface 20 and block 60 have machined grooves 66 and 68 respectively to accommodate the pipe 64. Similarly an end of a pipe 70 is trapped between the sheet 14 and the block 62, and the surface 22 and block 62 have machined grooves 72 and 74 respectively to accommodate the pipe 70. The ends and edges of the block 60 are welded to the sheet 12 and the periphery of the pipe 64 is welded to the sheet 12 and the block 60 to form a second sealed assembly except for the inlet provided by the pipe 64. Similarly the ends and edges of the block 62 are welded to the sheet 14 and the periphery of the pipe 70 is welded to the sheet 14 and the block 62 to form a third sealed assembly except for the inlet provided by the pipe 70.

The pipes 54, 64 and 70 are then connected to vacuum pumps which are used to evacuate the interior of the three sealed assemblies, and then inert gas for example argon, is introduced into the interior of the three sealed assemblies. This process of evacuating and supplying inert gas into the interior of the three sealed assemblies may be repeated several times in order to ensure that most, or substantially all, traces of oxygen are removed from the interiors of the three sealed assemblies. The smaller the traces of oxygen remaining, the greater the quality of the subsequent diffusion bonds.

The three sealed assemblies are then evacuated and are placed into an oven. The sealed assemblies are then heated to a temperature between 250° C. and 350° C. to evaporate the binder from the stop off material. During the baking out of the binder, the first sealed assembly is continuously evacuated to remove the binder from between the sheets 12 and 14. After the binder has been removed, which is determined either by monitoring the binder levels in the gas extracted from the first sealed assembly or by maintaining the first sealed assembly at the temperature between 250° C. and 350° C. for a predetermined time, the sealed assembly is removed from the oven and is allowed to cool to ambient temperature whilst being continuously evacuated. The binder is baked out of the first sealed assembly at a suitably low temperature to reduce, or prevent, oxidation of the exterior surfaces of the sealed assemblies.

The pipes 54, 64 and 70 are then sealed so that there is a vacuum present in each of the three sealed assemblies. The three sealed assemblies are then transferred carefully to an autoclave because the assemblies are fragile and easily damaged.

The temperature in the autoclave is increased such that the sealed assemblies are heated to a temperature greater than 850° C. and the argon pressure in the autoclave is raised to greater than 20 atmospheres, 294 lbs per square inch ($10.26\times10^5 Nm^{-2}$) and held at that temperature and pressure for a predetermined time. Preferably the sealed assemblies are heated to a temperature between 900° C. and 950° C. and the pressure is between 294 lbs per square inch ($20.26\times10^5 Nm^{-2}$) and 441 lbs per square inch ($30.39\times10^5 Nm^{-2}$). For example if the sealed assemblies are heated to a temperature of 925° C. and the pressure is raised to 300 lbs per square inch ($20.67\times10^5 Nm^{-2}$) the temperature and pressure are held constant for about two hours. The pressure is then reduced to ambient, diffusion bonding having been achieved and the three sealed assemblies which have then formed an integral structure are removed.

It is also possible to transfer the sealed assemblies directly to the autoclave, immediately after the pipes 54, 64 and 70 are sealed without the requirement to cool the sealed assemblies to ambient temperature, however some cooling of the sealed assemblies may occur.

The pipes 54, 64 and 70 are removed from the integral structure and a further pipe is fitted to the integral structure to connect with the stop off material 46, 48 applied to the flat surface 18 of the sheet 14. Argon, or other inert gas, is introduced into the preselected areas 46, within the integral structure in order to break the adhesive grip which the diffusion bonding pressure has brought about, this is known as "cracking". "Cracking" is achieved by introducing argon at high pressure via this further pipe into the preselected areas 46.

In particular the cracking operation is performed to ensure that the further pipe entry and the gas channel, defined by grooves 56 and 58 to which it connects, provide an open passageway and do not restrict pressurisation of the interior structure of the integral structure. The interior structure before cracking is of course defined by the preselected areas 46 of stop off material.

Cracking can be carried out at room temperature, when the metal exhibits normal elastic properties. Care is taken to ensure that the extension which occurs due to pressurisation with the argon does not go beyond the elastic limit. Consequently, the structure regains its shape when the pressure is removed at the end of the step. This is known as a "cold crack" technique.

Alternatively, cracking can be carried out at the temperature required for superplastic forming. This is known as a "hot crack" technique. In this case, plastic deformation of the structure produced by pressurisation must be insufficient to cause "ballooning" and thinness of the material in and near the further pipe entry.

Whether a cold crack or a hot crack operation is used is at the choice of the manufacturer, and is dependent upon the degree of control of expansion of the structure which can be exercised during pressurisation. This will depend partly upon the Geometric and material characteristics of the structures being pressurised and partly upon the fineness of control of pressurisation which is available. Unavoidably, these will be, at least to some extent, matters of experimentation at each different configuration of structure it is desired to manufacture.

Of the two techniques, hot cracking is the more convenient because it can be performed within the superplastic forming dies as the first stage in the superplastic forming process. However, it should only be adopted if the manufacturer is confident that he can control the process so as to avoid excessive plastic deformation when pressurising the structure, because otherwise rupture of one or more of the sheets 12, 14 can occur.

In both hot and cold cracking, the argon is introduced into the areas 46, 48, within the integral structure, containing the stop off material in order to break the adhesive grip which the diffusion bonding process has brought about. The argon is carefully introduced to those areas which contain the stop off, and the argon seeps through the stop off and eventually reaches all the areas covered by stop off. In some internal structures the argon may initially be caused to travel between one pair of workpieces. In any event, the argon should preferably travel the full length of the stop off material so as to break the adhesive grip between the stop off and the workpieces brought about during the diffusion bonding step.

Since the cracking operation is important for successful execution of the superplastic forming process, it will be described further below.

During cold cracking, a sequence of "pulses" of argon are introduced into the further pipe. Each pulse comprises a standard volume of gas at a high standard pressure and is introduced into the further pipe via a valve. After each pulse, or a predetermined number of pulses, readings are taken of the pressure in the further pipe at regular intervals over a set period of time, and the decay of pressure in the further pipe is observed. Simultaneously the thickness of the stack in the region of the gas channel 56, 58, 48 is measured to monitor the expansion due to the applied pressure. If pressure drop and expansion values over the set period of time are within predetermined ranges, the cracking process is known to be completed satisfactorily.

During hot cracking, the integral structure is held between the superplastic forming split dies which are used in the subsequent superplastic forming step. The superplastic forming dies are located in an autoclave. The autoclave is evacuated so as to avoid contamination of the titanium structure and the dies and integral structure are heated to superplastic forming temperature. A predetermined volume of high pressure argon, or other inert gas, is then introduced into the further pipe through a valve and the decay of pressure in the further pipe is observed to monitor the expansion due to the applied pressure. A pressure gauge or other device is used to measure the pressure in the further pipe. A rate of pressure decay of more than a predetermined value indicates that sufficient expansion has occurred in the gas channel 56, 58, 48 to facilitate subsequent superplastic expansion through application of further pressure pulses.

Completion of the forming of the integral structure into a plurality of components can now be achieved by the superplastic forming process.

If a hot crack operation has been carried out, the superplastic forming step can begin by introducing argon into the interior of the integral structure between the adjacent sheets 12, 14 so as to force the sheets 12, 14 into the respective die half shapes, which generates a plurality of hollow regions corresponding to the preselected areas 46.

If a cold crack operation has been used, the integral structure is placed between appropriately shaped split dies positioned within an autoclave. The autoclave is evacuated to avoid contamination of the titanium structure. The integral structure is again heated to superplastic forming temperatures. Argon is introduced into the interior of the integral structure between the adjacent sheets 12, 14, so as to force the sheets 12, 14 into the respective die half shapes, which generates a plurality of hollow regions corresponding to the preselected areas 46.

The magnitude of the movement of at least one of the sheets during deformation, is such as to require superplastic extension to occur. The term "superplastic" is a standard term in the metal forming art and will not be described herein.

In order to achieve superplastic forming without rupturing the thinning metal the argon is introduced in a series of pulses, at a precalculated rate which will achieve a desired strain rate, as is taught at PP 615–623 in the book "The Science, Technology and Application of Titanium" edited by R. I. Jaffe and N. E. Promisel, published by Pergamon press in 1970, which is hereby incorporated by reference. The method ensures that the metal is subjected to that strain rate which will achieve the maximum permissible speed of extension at any given point in the procedure. The rate of application, and/or volume of the pulses of the gas pulses may thus vary during the expansion of the sheets.

On completion of the superplastic forming, the inert gas atmosphere is maintained within the integral structure whilst the structure is cooled to ambient temperature.

Figure 6:
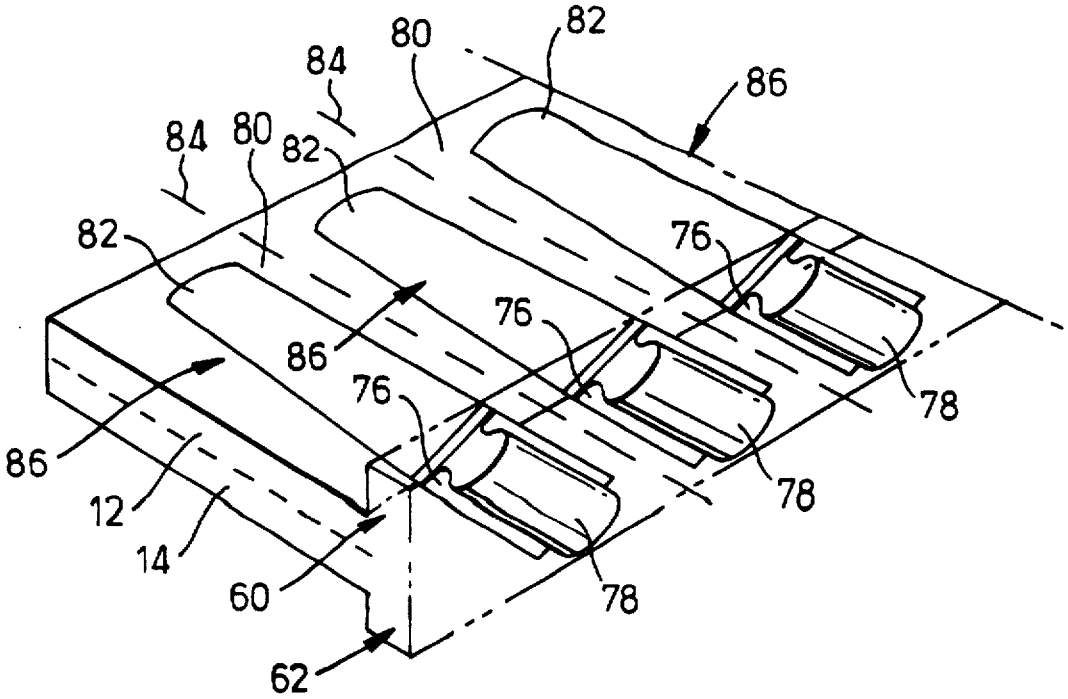
FIG. 6 is a perspective view of the articles after partial machining.
Figure 7:
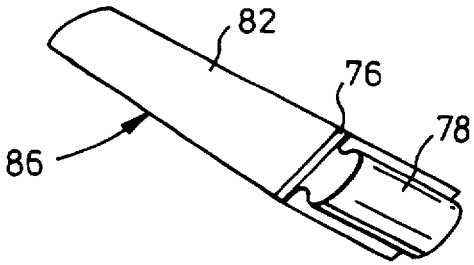
FIG. 7 is a perspective view of one of the articles after full machining.

Following the superplastic forming step the blocks 60, 62 and adjacent parts of the sheets 12 and 14 are machined to produce a plurality of platforms 76 and root shapes 78, e.g. dovetails as shown in FIG. 6. After machining the platform and root shapes the integral structure is cut into separate compressor blades 86 by machining through each of the webs 80, which correspond to webs 26, and the final aerofoil shape 82 is produced by for example electrochemical machining. The separating of blades 86 and forming of aerofoil shapes 82 is preferably achieved at the same time by electrochemical machining. This is achieved by placing the roots 78 of the blades 86 into holders, while the webs 80 still connect the blades 86 together, and connecting the holder to one pole of the electrochemical machine. The electrochemical machining electrodes trepan the individual aerofoils 82 from the integral structure as the electrodes meet at the leading edge and trailing edge of the aerofoils 82 of adjacent blades 86, i.e. the electrodes move longitudinally of the integral structure. The separating planes between adjacent blades 86 are indicated by numeral 84 and extend generally transversely of the integral structure. This is known as 360° electrochemical machining of the aerofoils.

Figure 8:
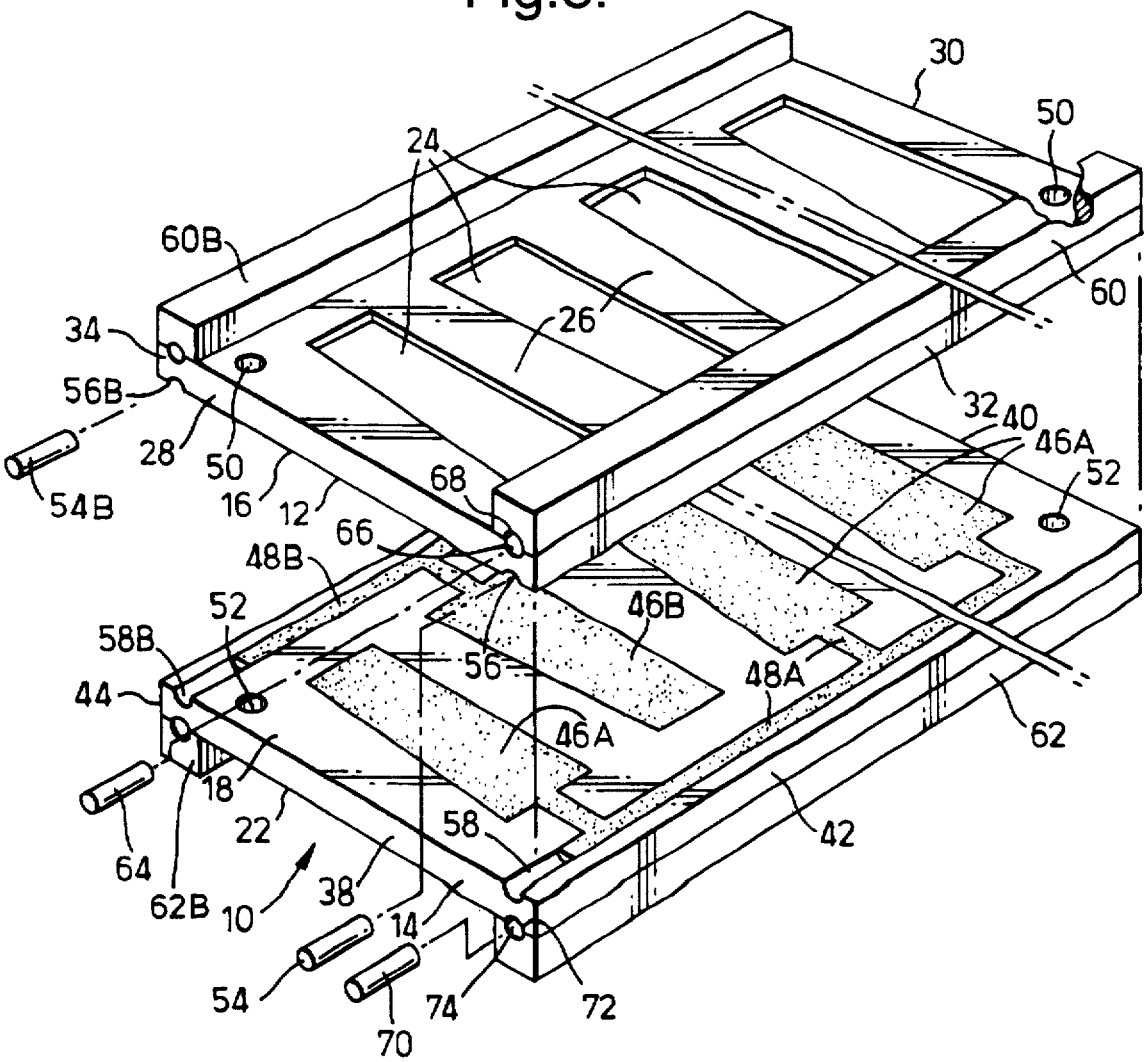
FIG. 8 illustrates an alternative perspective view of a stack of workpieces which are superplastically formed and diffusion bonded to form a plurality of articles according to the present invention.
Figure 9:
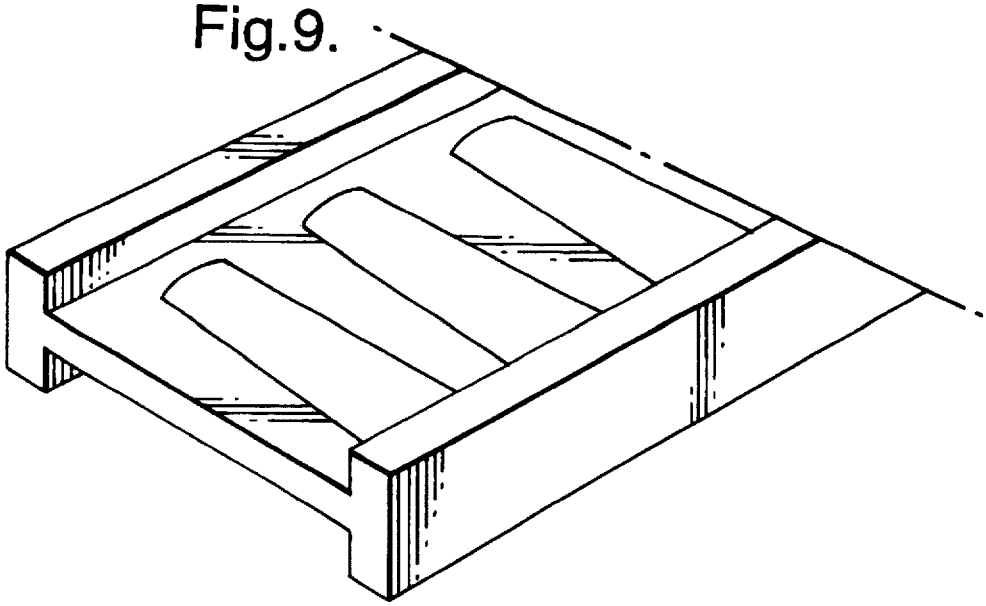
FIG. 9 illustrates a perspective view of the stack of workpieces in FIG. 8 after superplastic forming and diffusion bonding to form the articles.

A further embodiment of the invention is shown FIGS. 8 and 9 which differs in that alternate ones of the preselected areas 46 are interconnected together by stop off material 48, and adjacent preselected areas 46A, 46B are not interconnected. Thus there are two sets of stop off material 48A and 48B running longitudinally of the sheet 14, but are arranged at the opposite edges of the sheet 14. The preselected areas 46A are interconnected by stop off 48A and the preselected areas 46B are interconnected by stop off 48B. A further difference is that a further two titanium blocks 60B and 62B are located on the stack 10. These are also to form platform and root portions of the compressor blades. The blocks 60B and 62B are located immediately adjacent the edges 34 and 44 of sheets 12 and 14. The blocks 60B and 62B are diffusion bonded to the sheets 12 and 14 in a similar manner as described above. During cracking and superplastic forming both sets of preselected areas 46A and 46B are supplied with argon via passages 48A and 48B. Following superplastic forming platforms and roots are machined from both sets of block 60, 62 and 60B, 62B. The individual blades are then separated preferably by electrochemical machining.

Figure 10:
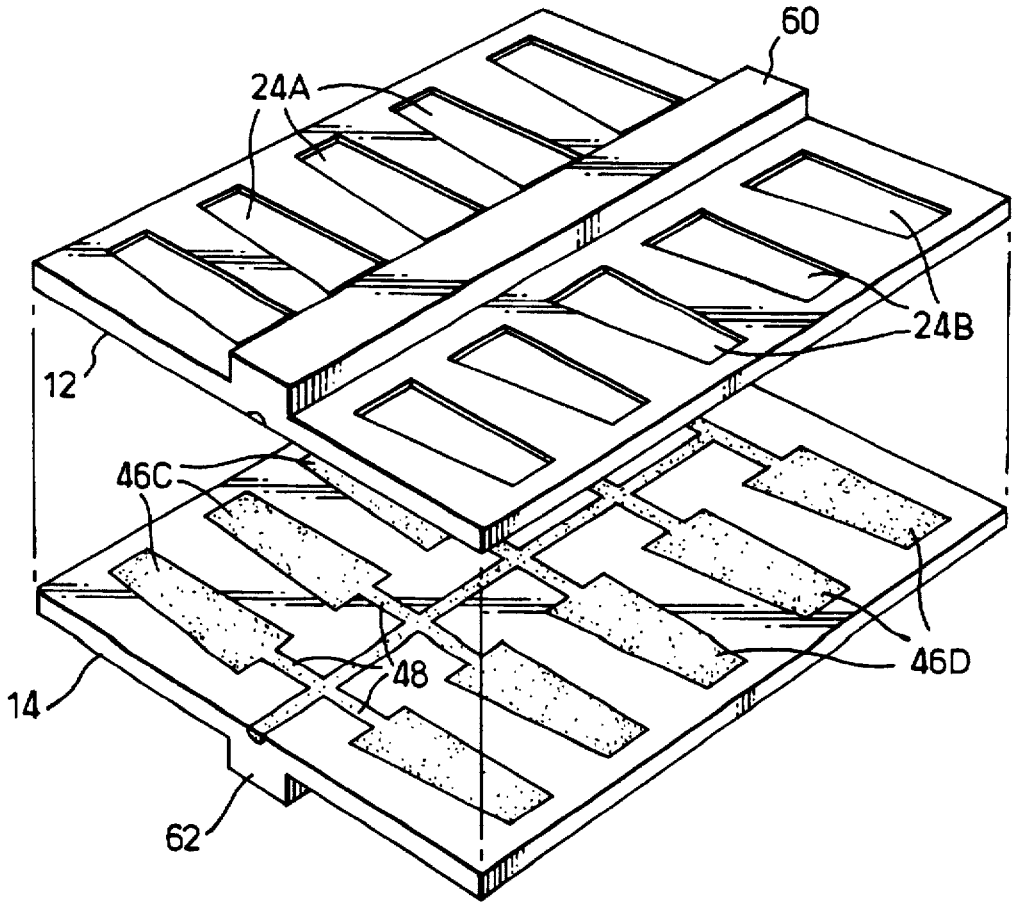
FIG. 10 illustrates another alternative perspective view of a stack of workpieces which are superplastically formed and diffusion bonded to form a plurality of articles according to the present invention.
Figure 11:
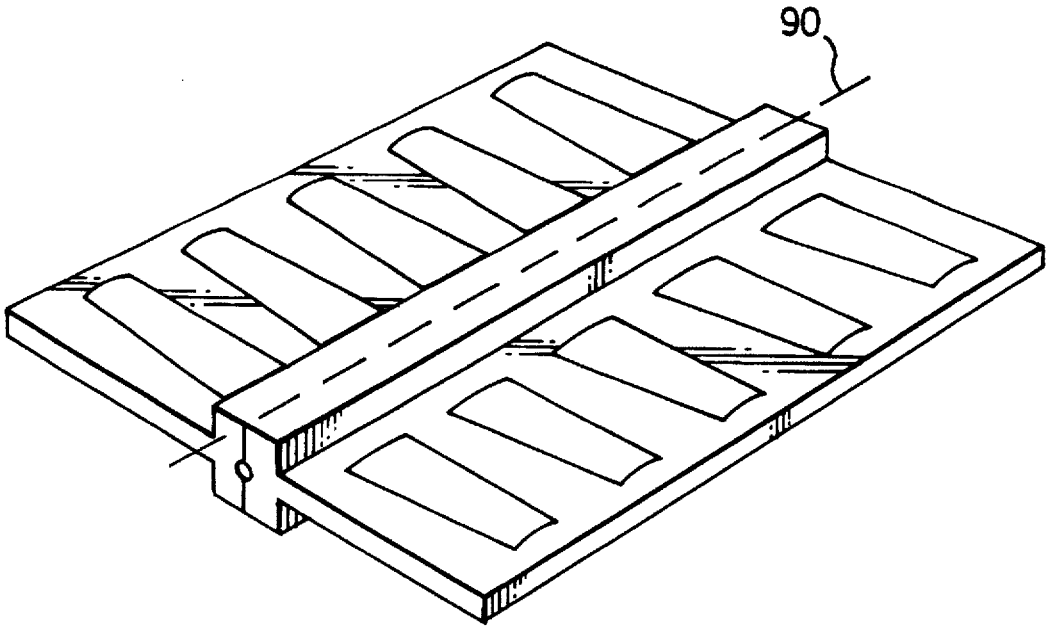
FIG. 11 illustrates a perspective view of the stack of workpieces in FIG. 10 after superplastic forming and diffusion bonding to form the articles.
Figure 12:
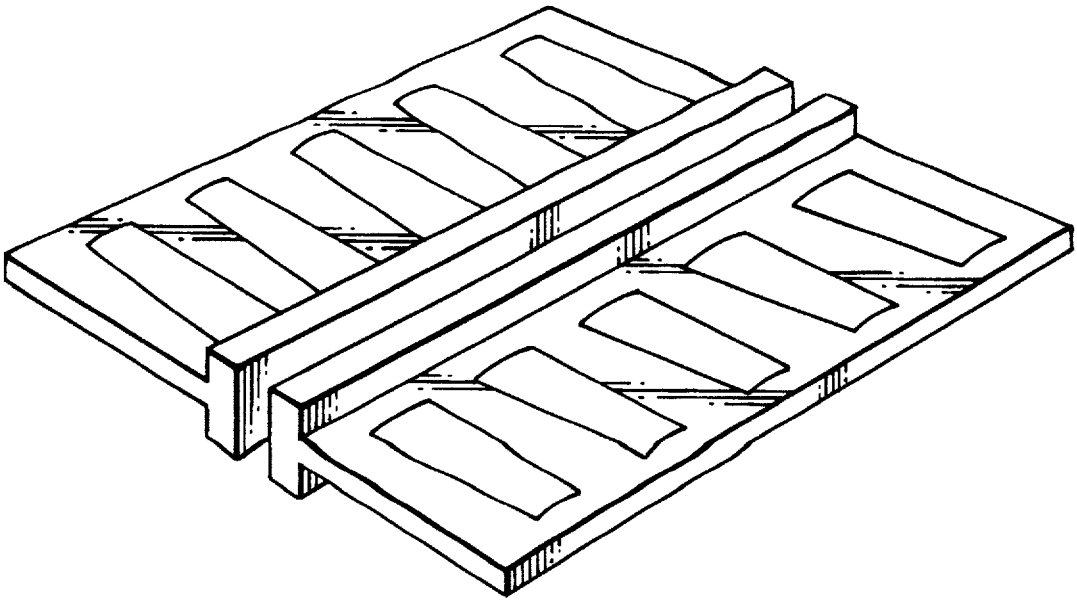
FIG. 12 illustrates a perspective view of the articles in FIG. 11 after partial machining.
Figure 13:
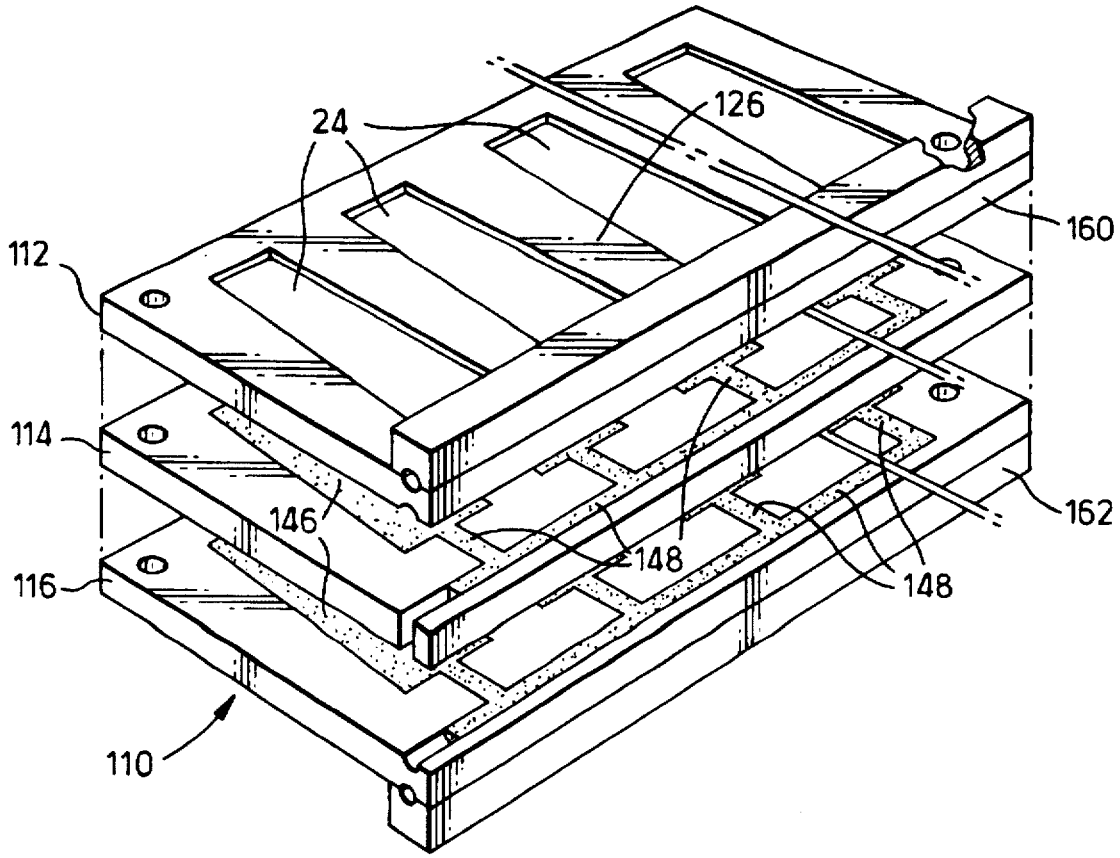
FIG. 13 illustrates a further alternative perspective view of a stack of workpieces which are superplastically formed and diffusion bonded to form a plurality of articles according to the present invention.

Another embodiment of the invention is shown in FIGS. 10, 11 and 12 which differs in that sheet 12 is machined at a first set of preselected regions 24A spaced apart longitudinally of the sheet 12 and is machined at a second set of preselected regions 24B spaced apart longitudinally of the sheet 12. The two sets of machined regions 24A and 24B are spaced apart transversely of the sheet 12. Similarly the sheet 14 is machined at two sets of preselected regions (not shown). Also two sets of preselected areas 46C and 46D of stop off are applied to sheet 14 as shown in FIG. 10. Furthermore the preselected areas of stop off 46A and 46B are interconnected by stop off material 48 extending longitudinally near the centre of the sheet 14. The two sets of preselected areas 46C and 46D of stop off are spaced apart transversely and are arranged either side of the stop off 48. Also the titanium blocks 60 and 62 are located near the centre of the sheets 12, 14 and extend longitudinally. During cracking and superplastic forming both sets of preselected areas 46C and 46D are supplied with argon from the passage defined by stop off 48. Following superplastic forming the blocks 60, 62 and sheets 12 and 14 are machined longitudinally along plane 90 as shown in FIG. 11 to cut the integral structure into two halves as shown in FIG. 12. The roots and platforms are machined from the blocks 60, 62 and then the individual blades are then separated preferably by electrochemical machining.

In an alternative method, the stack is prepared in the same manner as described previously for FIGS. 1 to 7. The stack is then placed in a vacuum chamber. The vacuum chamber is evacuated to evacuate the interior of the stack between the sheets and to evacuate the spaces between the blocks and the sheets. The vacuum chamber is supplied with argon to purge the interior of the stack, and is then evacuated again to remove oxygen. The vacuum chamber is heated to remove binder from the stop off while the vacuum chamber is continuously evacuated to remove the binder from between the sheets and from the vacuum chamber. After the binder has been removed, the ends and edges of the sheets are welded together, and the edges of the blocks are welded to the sheets, for example by an electron beam to provide a sealed assembly as described in our UK Patent No. 2256389B the contents of which are incorporated herein by reference. The diffusion bonding, superplastic forming and other steps previously described are then followed.

Figure 14:
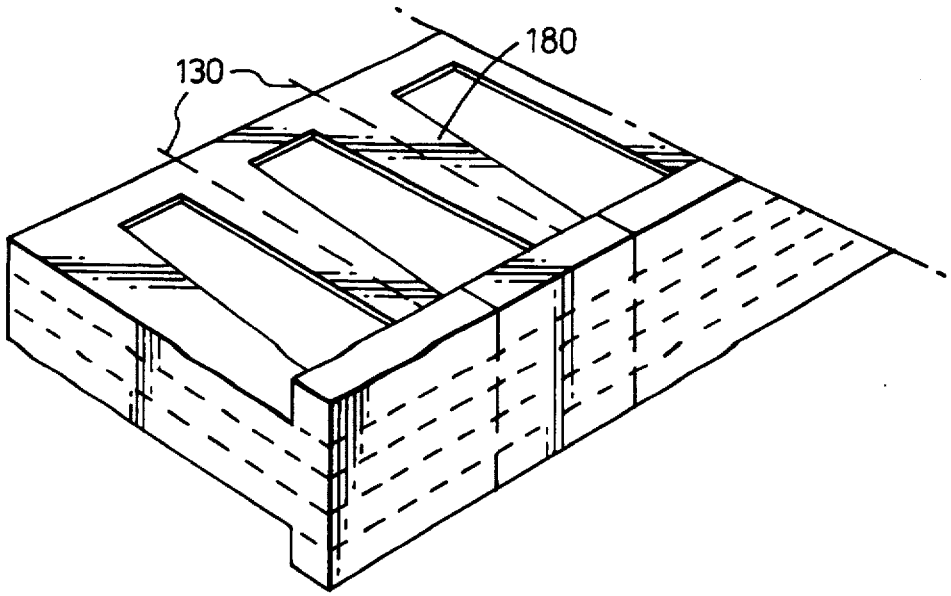
FIG. 14 illustrates a perspective view of the stack of workpieces in FIG. 13 after diffusion bonding.
Figure 15:
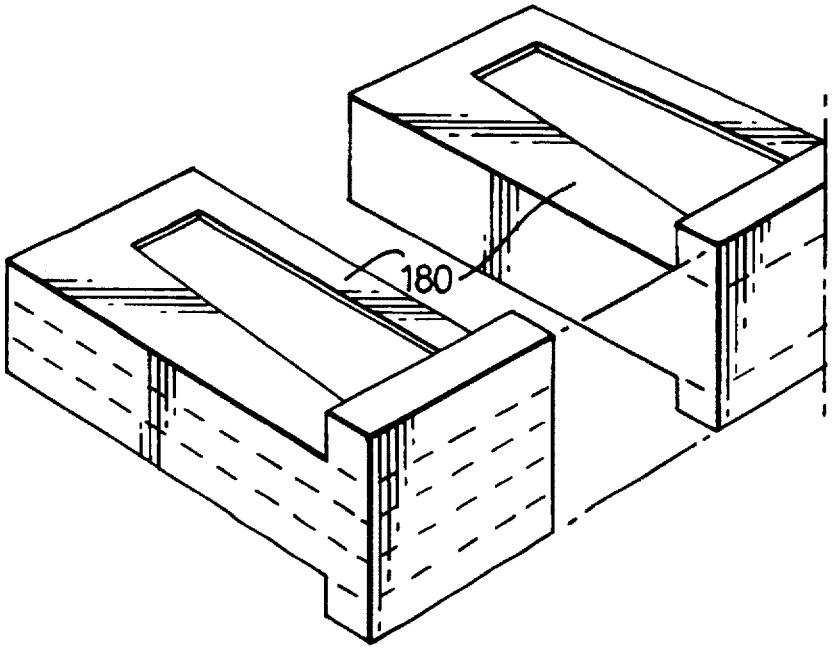
FIG. 15 illustrates a perspective view of the articles in FIG. 14 after partial machining.
Figure 16:
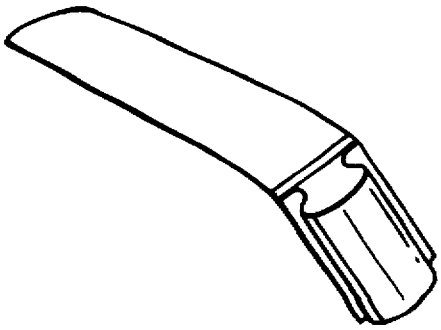
FIG. 16 illustrates a perspective view of one of the articles in FIG. 15 after superplastic forming.

A further variant of the invention shown in FIGS. 13 to 16 is suitable for producing fan blades with a wide chord. In this variant three titanium sheets 112, 114 and 116 are assembled to form a stack 110 together with blocks 160 and 162. The two outer sheets 112, 116 have machined regions 124, while each of the regions 146 is covered with stop off patterns to allow diffusion along one or more lines, at a plurality of circular areas or a combination of lines and circles or other suitable patterns. The process is the same until after diffusion bonding, thereupon the integral structure is machined transversely along planes 130 at the webs 180 as shown in FIG. 14 to separate the individual blades. Each blade is then placed into a twisting device as described in our UK Patent No. GB2073631B the contents of which are incorporated herein by reference. One end of the blade, ie the end with blocks 160 and 162 is located between a pair of relatively movable dies. The opposite end of the blade is located in a slot in a rotary member. The blade is then heated to 800° C. and a load is applied to the end of the blade in the dies to form a camber on that end. After the camber has been formed at one end of the blade, the opposite end of the blade in the slot is rotated by the rotary member so as to twist the blade into substantially the desired shape for the dies used for the superplastic forming process. Thereafter each of the blades is superplastically formed, and each blade has a root and platform machined from the blocks and the aerofoil portion is machined to shape. The blades may be superplastically formed sequentially individually or may be superplastically formed simultaneously in a manifolded set.

A further possibility for producing fan blades with low twist and camber is to superplastically form the integral structure to produce the plurality of hollow regions. The end of the superplastically formed integral structure with the blocks is cambered to form the camber for the roots of the fan blades. The integral structure is then machined to form slots extending transversely at the webs between the aerofoil portions of adjacent fan blades to separate the aerofoil portions, however the roots, i.e. the end of the integral structure with the blocks, of adjacent fan blades remain integral. The ends of the aerofoils remote from the roots, i.e. the ends of the integral structure with the blocks, are then twisted. After twisting of the aerofoils the roots and platforms are machined from the blocks while separating the individual fan blades and then the aerofoils are electrochemically machined to shape, or the aerofoils may be machined to shape and then the roots and platforms are machined from the blocks to separate the individual fan blades.

Another possibility for producing fan blades with a wide chord is to camber the end of the integral structure with the blocks to form the camber for the roots of the fan blades. The integral structure is then machined to form slots extending transversely at the webs between the aerofoil portions of adjacent fan blades to separate the aerofoil portions, however the blocks, of adjacent fan blades remain integral. The ends of the aerofoils remote from the roots, i.e. the ends of the integral structure with the blocks, are then twisted. Following twisting of the aerofoil portions the integral structure is superplastically formed to produce the plurality of hollow regions. After superplastic forming the integral structure the roots and platforms are machined from the blocks while separating the individual and then the aerofoils are electrochemically machined to shape, or the aerofoils may be machined to shape and then the roots and platforms are machined from the blocks to separate the individual fan blades.

It would be possible to have a further variation of the invention similar to that in FIGS. 10, 11 and 12 but in which each sheet has two sets of machined regions provided spaced apart transversely of the sheet and two sets of preselected areas of stop off material are applied to one of the sheets. But metal blocks are located at both edges of the sheets and extend longitudinally.

It would be possible to define the plurality of preselected spaced areas on at least one of the surfaces of at least one of the at least two metal workpieces by machining recesses at these areas, rather than by applying stop off material, however it is preferred to apply stop off material. If recesses are machined on the surfaces placed in mating abutment in the stack, it may not be necessary to machine areas on the opposite surfaces of the workpieces. The heating and pressurising step reinflates the hollow interiors of the articles to desired configuration rather than superplastically forming the hollow interiors of the articles. Alternatively stop off may be applied to the recesses to prevent diffusion bonding.

It may be possible to pretwist the workpieces rather than use flat workpieces and then to follow the same process steps.

The invention makes a plurality of hollow blades simultaneously from a minimum number of pieces of metal. The invention also machines the roots of the hollow blades while the hollow blades are all interconnected. The invention produces the final aerofoil shapes of the compressor blades by simultaneous electrochemical machining of a plurality of hollow blades.

The invention may also be applicable to the cost effective mass production of large numbers of identical, or similar, hollow articles by superplastic forming and diffusion bonding of superplastically extendable and diffusion bondable metallic workpieces. These workpieces include elementary metal, metal alloys, intermetallic materials and metal matrix composites. For example aluminium and stainless steel are capable of superplastic extension at suitable temperatures and pressures.

It is also possible to use more than three sheets in a stack depending upon the particular article to be manufactured.

The invention has been described with reference to solid state, or metallurgical, diffusion bonding in which the interface between the workpieces effectively disappears, however in circumstances in which the diffusion bond between the workpieces does not need to be as strong as a solid state diffusion bond it is possible to use activated diffusion bonding. In activated diffusion bonding an activator, such as a metal foil, is placed between the surfaces to be bonded. During the bonding process the activator material, upon reaching a certain temperature, transiently forms a liquid phase which forms an alloy with the workpieces. This immediately solidifies to form the bond.

The invention is also applicable to the production of hollow compressor vanes and hollow fan duct outlet guide vanes. The invention is also applicable to the production of heat exchanger panels in which the heat exchanger panels are separated from the integral structure and then are stacked and diffusion bonded or activated diffusion bonded together to produce a heat exchanger. Clearly the invention is applicable to the production of other articles, components or sub-components.

We claim:

1. A method of manufacturing hollow articles by superplastic forming and diffusion bonding at least two metal workpieces comprising the steps of (a) defining a plurality of spaced preselected areas of at least one of the surfaces of at least one of the at least two metal workpieces to prevent diffusion bonding at the preselected areas, each preselected area corresponding to the hollow interior of one of a plurality of hollow articles, (b) assembling the at least two workpieces into a stack, (c) applying heat and pressure across the thickness of the at least two metal workpieces to diffusion bond the at least two workpieces together, in areas other than the plurality of spaced preselected areas to form an integral structure, (d) heating and internally pressurising the preselected areas to cause the preselected areas to be superplastically formed to produce a plurality of hollow articles of predetermined shapes and a further step of parting the integral structure between the plurality of spaced preselected areas to provide a plurality of articles, said further step occurring between steps (c) and (d) or after step (d).

2. A method as claimed in claim 1 wherein step (a) comprises applying a stop off material to prevent diffusion bonding at each of the plurality of spaced preselected areas.

3. A method as claimed in claim 2 wherein each of the at least two metal workpieces has at least one flat surface, the stop off material is applied to at least one of the flat surfaces and the at least two workpieces are assembled into a stack relative to each other so that the flat surfaces are in mating abutment.

4. A method as claimed in claim 1 including machining at least one of the at least two metal workpieces at a plurality of spaced preselected areas, the machined areas being on the surfaces opposite to the surfaces which are to be diffusion bonded together, each machined area corresponding to an exterior surface of one of the plurality of hollow articles, the machined areas having a varying mass distribution.

5. A method as claimed in claim 1 wherein the heating and the internally pressurising of the preselected areas to cause the preselected areas to be superplastically formed to produce the hollow articles of predetermined shape precedes the parting of the integral structure between the plurality of spaced preselected areas to provide the plurality of hollow articles.

6. A method as claimed in claim 5 including machining one edge of the integral structure to form a plurality of root portions after heating and pressurising of the plurality of preselected areas to superplastically form the preselected areas to produce the hollow articles of predetermined shape and before parting of the integral structure between the plurality of spaced preselected areas to provide the plurality of hollow articles.

7. A method as claimed in claim 6 including after parting of the integral structure to provide the plurality of hollow articles, machining the remaining exterior surface portion of each of the articles to an aerofoil shape.

8. A method as claimed in claim 6 wherein the parting of the integral structure to provide the plurality of hollow articles includes simultaneously machining the remaining exterior surface portion of the integral structure to a plurality of aerofoil shapes.

9. A method as claimed in claim 5 including partially parting the hollow articles by forming slots from a first edge of the integral structure between the spaced preselected areas, heating the integral structure and applying loads to opposite ends of each of the plurality of articles to twist one end relative to the other end to contour each article to a predetermined shape after superplastically forming the spaced preselected areas to produce the hollow articles of predetermined shape and before parting of the integral structure.

10. A method as claimed in claim 9 including machining the edge opposite to the first edge of the integral structure to separate the articles and to form a plurality of root portions.

11. A method as claimed in claim 10 including after machining the roots, machining the twisted exterior surface portion of each of the articles to an aerofoil shape.

12. A method as claimed in claim 9 including machining the twisted exterior surface portion of each of the articles to an aerofoil shape.

13. A method as claimed in claim 12 including after machining the twisted exterior surface to an aerofoil shape, machining the edge opposite to the first edge of the integral structure to separate the articles and to form a plurality of root portions.

14. A method as claimed in claim 5 including partially parting the articles by forming slots from a first edge of the integral structure between the spaced preselected areas, heating the integral structure and applying loads to opposite ends of each of the plurality of articles to twist one end relative to the other end to contour each article to a predetermined shape after diffusion bonding of the workpieces to form the integral structure and before superplastically forming the spaced preselected areas to produce the hollow articles of predetermined shape and parting of the integral structure.

15. A method as claimed in claim 14 including before partially parting the articles, applying loads to the edge opposite to the first edge of the integral structure to camber said edge.

16. A method as claimed in claim 14 including machining the edge opposite to the first edge of the integral structure to separate the articles and to form a plurality of root portions.

17. A method as claimed in claim 16 including after machining the roots, machining the twisted exterior surface portion of each of the articles to an aerofoil shape.

18. A method as claimed in claim 14 including machining the twisted exterior surface portion of each of the articles to an aerofoil shape.

19. A method as claimed in claim 18 including after machining the twisted exterior surface to an aerofoil shape, machining the edge opposite to the first edge of the integral structure to separate the articles and to form a plurality of root portions.

20. A method as claimed in claim 1 wherein the parting of the integral structure between the plurality of spaced preselected areas to provide the plurality of articles precedes the heating and internally pressurising of the plurality of preselected areas to cause the preselected areas to be superplastically formed to produce the hollow articles of predetermined shape.

21. A method as claimed in claim 20 including heating each of the plurality of articles and applying loads to opposite ends of each of the plurality of articles to twist one end relative to the other end to contour each article to a predetermined shape after parting of the integral structure into a plurality of articles and before heating and pressurising of the plurality of the preselected areas to superplastically form the preselected areas to produce the hollow articles of predetermined shape.

22. A method as claimed in claim 21 including before the opposite ends of each article are twisted, heating and applying loads to one end of each article to camber said ends.

23. A method as claimed in claim 22 including machining the cambered end of each article to form a root portion.

24. A method as claimed in claim 21 including machining the remaining exterior surface portion of each article to an aerofoil shape.

25. A method as claimed in claim 7 wherein the machining of the exterior surface of the article to an aerofoil shape is electrochemical machining.

26. A method as claimed in claim 25 wherein the electrochemical machining includes trepanning the electrochemical machining electrodes.

27. A method as claimed in claim 1 wherein the plurality of spaced preselected areas are spaced apart longitudinally of the workpieces.

28. A method as claimed in claim 27 wherein at least some of the plurality of spaced preselected areas are spaced apart transversely of the workpieces.

29. A method as claimed in claim 1 wherein at least one metal block is assembled with the at least two metal workpieces into a stack so that the at least one metal block is at a first edge of the stack, and diffusion bonding the at least one metal block to the metal workpieces.

30. A method as claimed in claim 29 wherein two metal blocks are assembled at the first edge of the stack and on opposite surfaces of the stack.

31. A method as claimed in claim 29 wherein at least one other metal block is assembled with the at least two metal workpieces and the at least one metal block into a stack so that the at least one metal block is at a first edge of the stack and the at least one other metal block is at the opposite edge of the stack and diffusion bonding the metal blocks to the metal workpieces.

32. A method as claimed in claim 1 wherein at least one metal block is assembled with the at least two metal workpieces into a stack so that the at least one metal block is at a central region of the stack and diffusion bonding the at least one metal block to the metal workpieces.

33. A method as claimed in claim 31 wherein two metal blocks are assembled at the central region of the stack and on opposite surfaces of the stack.

34. A method as claimed in claim 32 including machining the integral structure longitudinally through the centre of the at least one metal block.

35. A method as claimed in claim 1 wherein the article is a blade or vane for a gas turbine engine.

36. A method as claimed in claim 1 wherein the article is a heat exchanger panel for a heat exchanger.

37. A method as claimed in claim 1 wherein the diffusion bonding is activated diffusion bonding.

* * * * *